US005759727A

United States Patent [19]

Malhotra

[11] Patent Number: 5,759,727

[45] Date of Patent: Jun. 2, 1998

[54] METHOD OF GENERATING SIMULATED PHOTOGRAPHIC QUALITY IMAGES ON LUMINESCENT, MIRROR COATED, MELT-FORMED BACKING SUBSTRATES

[75] Inventor: Shadi L. Malhotra, Mississauga, Canada

[73] Assignee: Xerox Corporation, Stamford, Conn.

[21] Appl. No.: 785,114

[22] Filed: Jan. 21, 1997

[51] Int. Cl.[6] ..... G03G 13/01; B44C 1/165

[52] U.S. Cl. ..... 430/97; 430/47; 430/124; 156/230; 156/239; 156/241

[58] Field of Search ..... 430/47, 97, 124; 156/230, 239, 241

[56] References Cited

U.S. PATENT DOCUMENTS

| | | | |
|---|---|---|---|
| 5,320,902 | 6/1994 | Malhotra et al. | 428/342 |
| 5,327,201 | 7/1994 | Coleman et al. | 355/278 |
| 5,337,132 | 8/1994 | Cherian | 355/278 |
| 5,418,208 | 5/1995 | Takeda et al. | 503/227 |

*Primary Examiner*—Mark Chapman

[57] ABSTRACT

Disclosed is a method of creating simulated photographic-quality prints using non-photographic imaging, including the steps of: (a) providing a coated transparent substrate having a toner image formed thereon using a non-photographic imaging process, (b) providing the surface of a backing substrate derived from a composition that can be melt formed and extruded in to a self supporting film and is comprised of a blend consisting of (1) a thermoplastic polymer, (2) a fluorescent brightner, (3) plasticizers having a melting point of less than 75° C., (4) lightfastness inducing agent, (5) antistatic agent and (6) filler, melt formed and extruded in to a self supporting film, (c) providing a metallic coating on one side covering from about 60 to about 90 percent surface of the self supporting film, (d) adhering the coated transparent substrate having the toner image to the metallized film using heat and pressure.

20 Claims, 2 Drawing Sheets

METHOD OF GENERATING SIMULATED PHOTOGRAPHIC QUALITY IMAGES ON LUMINESCENT, MIRROR COATED, MELT-FORMED BACKING SUBSTRATES

BACKGROUND OF THE INVENTION

The present invention is directed to creating simulated, photographic-quality prints and substrates suitable for use in creating simulated photographic-quality images or prints using non-photographic imaging such as xerography and/or ink jet printing and/or copying. More specifically, the present invention is directed to creating simulated, photographic-quality prints which exhibit right reading images in a luminescent reflective mirror background.

In the practice of conventional xerography, it is the general procedure to form electrostatic latent images on a xerographic surface by first uniformly charging a charge retentive surface such as a photoreceptor. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, the toner generally comprises black thermoplastic powder particles which adhere to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic and/or ink jet imaging process. Such efforts have resulted in the introduction of the Xerox 5775™ copier/printer, the Xerox 4900™ and the Fuji Xerox A-Color 635™ machine into the market place.

Notwithstanding all the recent development in the area of color printers and copiers there is room for improvement in the quality of color images on paper and synthetic substrates such as Mylar® and Teslin®. The foregoing is particularly true when trying to create photographic-quality images using non photographic processes.

Attempts at improving conventionally formed color toner images have led to the lamination of xerographic images on paper using a transparent substrate. This procedure has been only partially successful because the lamination process tends to reduce the density range of the print resulting in a print that has less shadow detail. The lamination process also adds significant weight and thickness to the print.

Additionally, it is believed that the aforementioned lamination process doesn't produce good results because typically the color toner images at the interface between the laminate and the toner do not make suitable optical contact. That is to say, the initially irregular toner image at the interface is still irregular (i.e. contains voids) enough after lamination that light is reflected from at least some of those surfaces and is precluded from passing through the toner. In other words, when there are voids between the transparency and toner image, light gets scattered and reflected back without passing through the colored toner. Loss of image contrast results when any white light is scattered, either from the bottom surface of the transparent substrate or from the irregular toner surfaces and doesn't pass through the toner.

A known method of improving the appearance of color xerographic images on a transparent substrate comprises refusing the color images. Such a process was observed at a NOMDA trade show in 1985 at a Panasonic exhibit. The process exhibited was carried out using an off-line transparency fuser, available from Panasonic as model FA-F100, in connection with a color xerographic copier which was utilized for creating multi-color toner images on a transparent substrate for the purpose of producing colored slides. Since the finished image from the color copier was not really suitable for projection, it was refused using the aforementioned off-line refuser. To implement the process, the transparency is placed in a holder intermediate which consists of a clear relatively thin sheet of plastic and a more sturdy support. The holder is used for transporting the imaged transparency through the off-line refuser. The thin clear sheet is laid on top of the toner layer on the transparency. After passing out of the refuser, the transparency is removed from the holder. This process resulted in an attractive high gloss image useful in image projectors. The refuser was also used during the exhibit for refusing color images on paper. However, the gloss is image-dependent. Thus, the gloss is high in areas of high toner density because the toner refuses in contact with the clear plastic sheet and becomes very smooth. In areas where there is little or no toner the gloss is only that of the substrate. The refuser was also used during the exhibit for refusing color images on paper.

Following is a discussion of additional prior art which may bear on the patentability of the present invention. In addition to possibly having some relevance to the question of patentability, these references, together with the detailed description to follow, should provide a better understanding and appreciation of the present invention. The prior art discussed herein as well as the prior art cited therein is incorporated herein by reference.

Copending application U.S. Ser. No. 08/583,913 filed on Jan. 11, 1996, with the named inventor Shadi L. Malhotra, discloses that coated sheets or substrates such as paper, opaque Mylar®, Teslin® or the like are utilized in the creation of simulated, photographic-quality prints formed using non photographic imaging procedures such as xerography and ink jet. A first substrate has a reverse reading image formed thereon. Such an image may be formed using conventional color xerography. A second substrate having a right reading image containing the same information as the first substrate is adhered to the first substrate. The foregoing results in a simulated photographic-quality print which has a relatively high optical density compared to prints using only the reverse reading image on the one substrate. This application including all of the references cited therein are incorporated herein by reference.

U.S. Pat. Nos. 5,327,201 and 5,337,132 granted to Robert E. Coleman on Jul. 5, 1994 and to Abraham Cherian on Aug. 9, 1994, respectively, disclose the creation of simulated photographic prints using xerography. To this end, reverse reading images are formed on a transparent substrate and backing substrate is adhered to the transparent substrate. U.S. patent application Nos. 08/095,639, 08/095,622, 08/095,016, 08/095,136 and 08/095,639 cited in the '132 patent are also incorporated herein by reference.

Protective sheets used in various printing and imaging processes are well known. For example, U.S. Pat. No. 5,418,208 (Takeda and Kawashima) discloses a laminated plastic card providing a lamination of a dye accepting layer, a substrate of paper or the like, and a back coat layer on which lamination one or more patterns are printed with a volatile dye, and a transparent plastic film adhered on the lamination by an adhesive agent, wherein the adhesive agent is a saturated polyester having an average molecular weight of 18,000 gm/mole and produced by condensation polymerization of polypropylene glycol or trimethylol propane and adipic acid or azelaic acid.

BRIEF SUMMARY OF THE INVENTION

The present invention is directed to creating and using coated backing substrates or substrates such as paper, opaque Mylar®, Teslin® or the like. The sheets or substrates (FIG. 1) are utilized in creating simulated photographic-quality prints using non-photographic imaging procedures such as xerography and ink jet.

Image enhancement is effected using an adhesive in the form of binder coating on a backing substrate which exhibits the same physical properties as the material used for forming xerographic images on a transparent substrate to which the backing substrate is to be adhered. One other property is the capability to generate luminescence so that the image is brighter. In the past, adhesives containing luminescent compositions capable of generating fluorescence, phosphorescence or chemiluminescence phenomenon on a backing substrate as well as luminescent backing substrates obtained by melt forming and extruding a composition comprised of a thermoplastic polymer, a luminescent composition, a light-fastness inducing agent, an antistatic agent, a plasticizer and a filler exhibited improved brighter images. There is yet another way to improve the brightness of an image by providing a reflective metallic mirror surface on one side of the extruded luminescent backing substrate comprised of a thermoplastic polymer, a luminescent composition, a light-fastness inducing agent, an antistatic agent, a plasticizer and a filler and laminating on this reflective metallic mirror surface containing luminescent backing side the reverse image containing transparent substrate.

In accordance with the invention, a composition comprised of (1) a thermoplastic polymer, such as polyethylene such as #041, #042, #535, #536, #558, #560, available from Scientific Polymer Products, polypropylene such as #130, #780, #781, #782, #783, available from Scientific Polymer Products, poly(1-butene) such as #128, #337, #338, available from Scientific Polymer Products, poly(isobutylene) such as #040A, #040B, #040E,#668, #681, #683, #684, available from Scientific Polymer Products; (2) fluorescent brightners that are derived from fluorescent dyes as well as polymeric dyes such as polymeric phthalocyanines, and the like; (3) plasticizers having a melting point of less than 75° C. and selected from the group comprising bis (4-nitrobenzyl) phosphite, (Aldrich 29,367-9), triphenyl phosphate, (Aldrich 24,128-8), triphenyl ethylene, (Aldrich T8,280-5), tripalmitin, (Aldrich 23,471-0), trihexyl trimellitate, (Aldrich 38,899-8), trioctyl trimellitate, (Aldrich 36,860-1) and the like; (4) lightfastness inducing agents including UV absorbing compounds including 2-(4-benzoyl-3-hydroxyphenoxy)ethylacrylate, (Cyasorb UV-416, #41,321-6, available from Aldrich chemical company), 1,2-hydroxy-4-(octyloxy)benzophenone, (Cyasorb UV-531, #41,315-1, available from Aldrich chemical company), antioxidant and antiozonant compounds such as 2,2'-methylenebis(6-tert-butyl-4-methylphenol) (Cyanox 2246, #41,315-5, available from Aldrich chemical company), 2,2'-methylenebis(6-tert-butyl-4-ethylphenol) (Cyanox 425, #41,314-3, available from Aldrich chemical company); (5) antistatic agents, including both anionic and cationic materials such as anionic antistatic components derived from monoester sulfosuccinates, diester sulfosuccinates and sulfosuccinamates and cationic antistatic components derived from quaternary salts; quaternary acrylic copolymer latexes; ammonium quaternary salts as disclosed in U.S. Pat. No. 5,320,902 (Malhotra et al); (6) and fillers such as blend of calcium fluoride and silica, such as Opalex-C available from Kemira.O.Y. zinc oxide, such as Zoco Fax 183, available from Zo Chem, blends of zinc sulfide with barium sulfate, such as Lithopane, available from Schteben Company, and the like; can be melt formed and extruded in to a self supporting film that can be used as the backing sheet. This sheet is further vapor deposited with a metallic mirror coating of aluminum, silver, gold, tin, and the like in a thickness of 5 microns and then heat laminated to a reverse image containing transparent substrate thereby yielding a simulated photographic quality right reading images in a luminescent reflective mirror background.

The procedure for adhering the backing substrate or substrates to the wrong reading containing or reverse imaged transparency is effected using a temperature of about 100° C. to about 150° C. and a pressure of about 75 psi to about 125 psi. The imaged transparent substrate may comprise a plastic sheet such as polyester or Mylar®). Other features of the present invention will become apparent as the following description proceeds and upon reference to the drawings, in which:

DETAILED DESCRIPTION OF THE PREFERRED EMBODIMENT OF THE INVENTION

Figure 1:
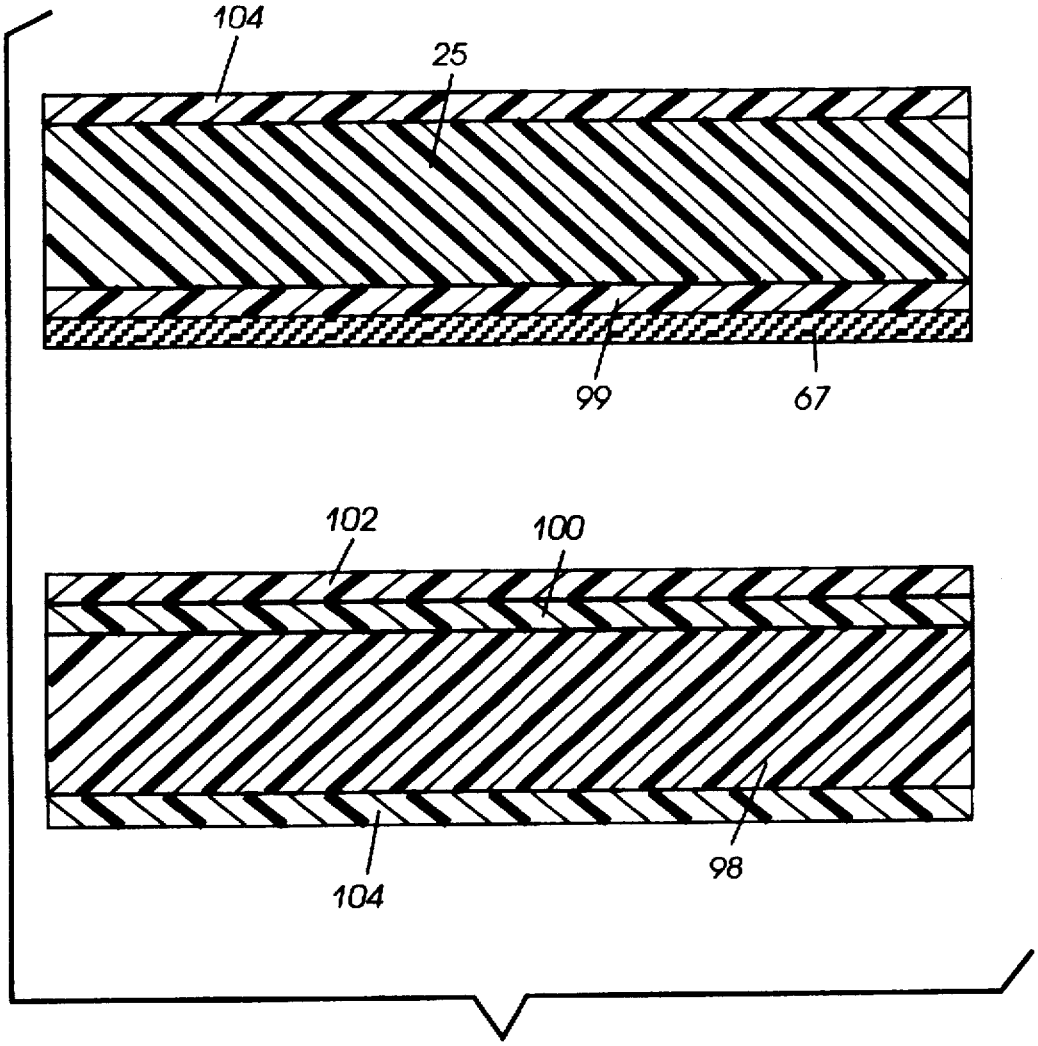
FIG. 1 is a view of a pair of substrates, one a transparency containing a wrong reading image on coating 99 and the other a fluorescent thermoplastic melt formed backing substrate 98 containing metallic mirror coating 97. Lamination of imaged transparencies with the coated backing substrate create a simulated color, photographic-quality print.

For a general understanding of the features of the present invention, reference is made to the drawings. In the drawings, like reference numerals have been used throughout to identify identical elements.

While the present invention will hereinafter be described in connection with least one preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention is equally well suited for use in a wide variety of printing systems, and is not necessarily limited in its application to the particular system shown herein.

Figure 2:
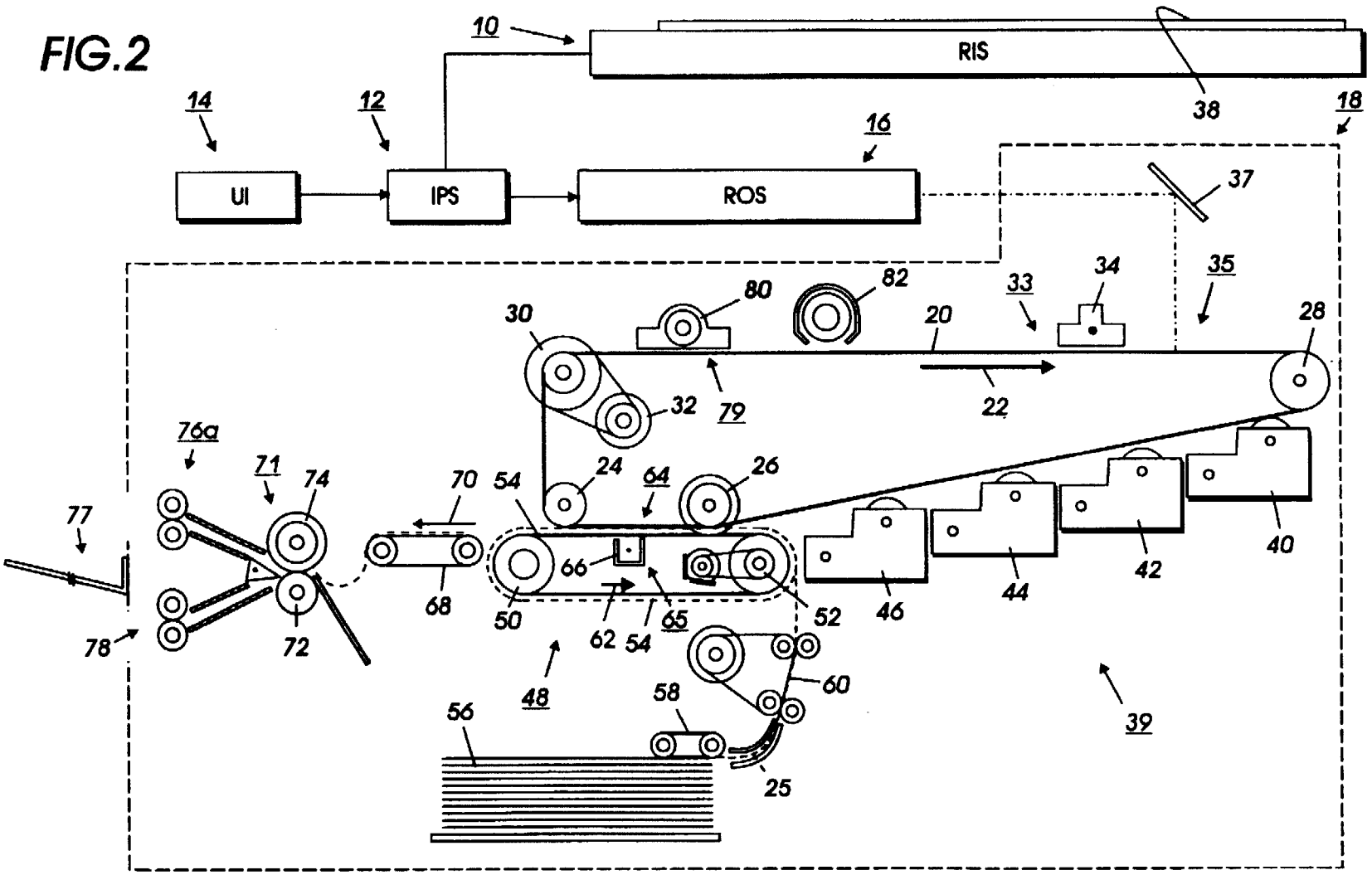
FIG. 2 is a schematic elevational view of an illustrative electrophotographic copier which may be utilized in carrying out the present invention.

Turning initially to FIG. 2, during operation of a printing system 9, a multi-color original document or photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16, which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon. The printing system 9 is capable of printing conventional right reading toner images on plain paper or mirror images on various other kinds of substrates utilized in the commercially available 5775™ copier. With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of calorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with a rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

According to the present invention, the document 38 preferably comprises a black and white or color photographic print. It will be appreciated that various other documents may be employed without departing from the scope and true spirit of the invention.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 2 developer unit 40 is shown in the operative position with developer units 42, 44 and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred to a transparent substrate 25. At transfer station 65, a substrate transport apparatus, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper, not shown. In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 move in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multi-color image.

Referring again to FIG. 2 one skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, to the substrate to form a multi-color facsimile of the colored original document. As may be appreciated, the imaging process is not limited to the creation of color images. Thus, high optical density black and white simulated photographic-quality prints may also be created using the process disclosed herein.

After the last transfer operation, the substrate gripper opens and releases the substrate 25. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 so as to be affixed to the transparent substrate. Thereafter, the substrate is advanced by a pair of rolls 76 to an outlet opening 78 through which substrate 25 is conveyed. Alternatively, the substrates can be advanced by a pair of rollers **76*a* to a catch tray 77**.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

A process and apparatus for forming simulated photographic-quality prints which use the transparency 25 containing the composite, reverse reading color image 67 and a coated backing substrate 98 are disclosed in U.S. Pat. No. 5,337,132 granted to Abraham Cherian on Aug. 9, 1994. Alternatively, simulated photographic-quality prints may be created using the apparatus and method described in U.S. Pat. No. 5,327,201 granted to Coleman et al on Jul. 5, 1994.

The substrates or sheets 25 and 98 comprise substrates or sheets, each having a coating on one side thereof. Any suitable substrate material can be employed.

Examples of suitable substantially transparent substrate materials are disclosed in U.S. patent application 08/720,656 filed Oct. 2, 1996, the disclosure of which is incorporated herein by reference.

The substrates can be of any effective thickness. Typical thicknesses for the substrate are from about 25 to about 500 microns, and preferably from about 100 to about 125 microns, although the thickness can be outside these ranges.

Each of the substrates 25 and 98 may be provided with one or more coatings for producing enhanced simulated color photographic-quality prints using non photographic imaging processes such as xerography. Each substrate is preferably coated on one side with at least one coating.

The transparent substrate 25 is provided with a coating 99 on each side or surface thereof which coating is comprised of, for example, a hydrophilic polymer such as a latex polymer.

In a first coating 99 a binder may be present in any effective amount; typically the binder or mixture thereof is present in amounts of from about 70 percent by weight to about 90 percent by weight although the amounts can be outside of this range. The coating 99 contains an optional antistatic agent, biocide and/or filler may be included in the coating 99.

The backing substrate 98 of the present invention is derived from a polymer that can be melt extruded, and has a softening point of less than 150° C. Additionally, the backing substrate has built-in, lightfastness and antistatic properties, is fluorescent and may contain filler and pigment components and optional plasticizers. Preferably the backing substrate is an extruded sheet containing a fluorescent composition, lightfastness inducing agent, an antistatic material, a plasticizer and a filler. The thickness of the extruded sheet may vary from about 50 microns to about 500 microns although the thickness can be outside of this range.

In the composition of the backing substrate the extrudable polymer can be present in any effective amount; typically the extrudable polymer or mixture thereof are present in amounts of from about 40 percent by weight to about 90 percent by weight although the amounts can be outside of this range. The fluorescent composition or mixture thereof are present in the extrudable composition, in amounts of from about 0.5 percent by weight to about 40 percent by weight although the amounts can be outside of this range. The antistatic agent or mixture thereof are present in the extrudable coating composition, in amounts of from about 0.5 percent by weight to about 20 percent by weight although the amounts can be outside of this range. The lightfastness inducing compounds or mixture thereof are present in the extrudable composition, in amounts of from about 0.5 percent by weight to about 20 percent by weight although the amounts can be outside of this range. The plasticizer or mixture thereof are present in the extrudable coating composition, in amounts of from about 0.5 percent by weight to about 20 percent by weight although the amounts can be outside of this range. The fillers or mixture thereof are present in the extrudable coating composition, in amounts of from about 0.5 percent by weight to about 50 percent by weight although the amounts can be outside of this range.

The metallic mirror coating 97 on the backing substrate 98 of the present application is from about 0.1 microns to about 25 microns and preferably from about 0.5 micron to about 5 microns and is vapor deposited from a hot vacuum sublimator. The metallic mirror coating 97 covers from about 50 to about 95 percent of the total surface of the extruded film, and preferrably from about 70 to about 90 percent of the total surface of the extruded film, leaving an even border on the outer side of the film as shown in FIG. 1.

Examples of suitable binder polymers for use as coating 99 are disclosed in U.S. patent application 08/720,656 filed Oct. 2, 1996, the disclosure of which is incorporated herein by reference.

In addition, the first coating 99 may contain antistatic agents. Antistatic components can be present in any effective amount, and if present, typically are present in amounts of from about 0.5 to about 20.0 percent by weight of the coating composition.

Suitable antistatic agents include both anionic and cationic materials.

Monoester sulfosuccinates, diester sulfosuccinates and sulfosuccinamates are anionic antistatic components which have been found suitable for use in the first coating 99 as well as in melt-formed backing substrates 98.

Suitable cationic antistatic components comprise diamino alkanes; quaternary salts; quaternary acrylic copolymer latexes such as HX-42-1, HX-42-3available from Interpolymer Corporation; ammonium quaternary salts as disclosed in U.S. Pat. No. 5,320,902 (Malhotra et al); phosphonium quaternary salts as disclosed in Copending application U.S. Ser. No. 08/034,917 and sulfonium, thiazolium and benzothiazolium quaternary salts as disclosed in U.S. Pat. No. 5,314,747 (Malhotra and Bryant).

In one embodiment the first coating on the transparent substrate is comprised of from about 98.5 percent by weight to about 55 percent by weight of the binder or mixture thereof, from about 0.5 percent by weight to about 20 percent by weight of the antistatic agent or mixture thereof, from about 0.5 percent by weight to about 20 percent by weight of the lightfastness inducing agent or mixture thereof from about 0.5 percent by weight to about 5 percent by weight of the filler or mixture thereof.

Examples of suitable thermoplastic extrudable polymers for use in the backing substrates 98 of the present invention include polyalkylenes and their copolymers wherein alkyl has from 2 to about 6 carbon atoms, including, ethyl, propyl, butyl, including polyethylene such as #041, #042, #535, #536, #558, #560, available from Scientific Polymer Products, and #26,935-2; #42,803-5; #42,807-8; #42,808-6; #42,809-4; #42,810-8; #42,796-9; #42,798-5; #42,799-3; #42,901-5; #42,777-2; #42,778-0; #42,779-9; available from Aldrich Chemical Company, polypropylene such as #130, #780, #781, #782, #783, available from Scientific Polymer Products, and #42,811-6; #42,902-3; available from Aldrich Chemical Company, poly(1-butene) such as #128, #337, #338, available from Scientific Polymer Products, poly (isobutylene) such as #040A, #040B, #040E, #668, #681, #683, #684, available from Scientific Polymer Products, poly(propylene-co-ethylene)copolymer such as #454, #455, available from Scientific Polymer Products and #42,792-6; #42,795-0; #42,794-2; #42,913-9; #42,819-1; #42,820-5; available from Aldrich Chemical Company, poly(ethylene-co-1-butene) copolymer such as #43,469-8; #43,472-8; available from Aldrich Chemical Company, poly (ethylene-co-1-butene-co-1-hexene) copolymer such as #43,474-4; #43,475-2; available from Aldrich Chemical Company, poly (ethylene-co-1-methylacrylate) copolymer such as #43,263-6; #43,264-4; #43,265-2; available from Aldrich Chemical Company, poly(ethylene-co-methylacrylate-co-glycidyl methacrylate) copolymer such as #43,364-0; available from Aldrich Chemical Company, poly(ethylene-co-ethylacrylate) copolymer such as #358, available from Scientific Polymer Products, poly(ethylene-co-ethylacrylate-co-maleic anhydride) copolymer such as #43,083-8; #43,084-6; available from Aldrich Chemical Company, poly (ethylene-co-butylacrylate) copolymer such as #43,077-3; #43,078-1; available from Aldrich Chemical Company, poly (ethylene-co-butylacrylate-co-carbon monoxide) copolymer such as #43,064-1; #43,066-8; available from Aldrich Chemical Company, poly(ethylene-co-glycidylyl methacrylate) copolymer such as #43,086-2; available from Aldrich Chemical Company, poly(ethylene-co-carbon monoxide) copolymer such as #42,835-3; available from Aldrich Chemical Company, poly(ethylene-co-acrylic acid) copolymer such as #42,671-7; #42,672-5; available from Aldrich Chemical Company, poly(ethylene-co-acrylic acid) copolymer sodium salt such as #42,674-1; #42,673-3; available from Aldrich Chemical Company, poly(ethylene-co-acrylic acid) copolymer zinc salt such as #42,676-6; #42,676-8; available from Aldrich Chemical Company, poly (ethylene-co -methacrylic acid) copolymer such as #42,662-8; #42,663-6; #42,664-4; available from Aldrich Chemical Company, poly(ethylene-co-methacrylic acid) copolymer lithium salt such as #42,670-9; available from Aldrich Chemical Company, poly(ethylene-co-methacrylic acid) copolymer sodium salt such as #42,669-5; available from Aldrich Chemical Company, poly(ethylene-co-methacrylic acid) copolymer zinc salt such as #42,668-7; #42,666-0; available from Aldrich Chemical Company, poly(ethylene-co-vinyl acetate-co-methacrylic acid) copolymer such as #42,654-7; #42,655-5; available from Aldrich Chemical Company, poly(ethylene-co-vinyl acetate-co-carbon monoxide) copolymer such as #43,062-5; available from Aldrich Chemical Company, poly(ethylene-co-vinyl acetate)-graft-poly(maleic anhydride) copolymer such as #42,652-0; #42,653-9; available from Aldrich Chemical Company, poly(ethylene)-graft-poly(maleic anhydride) copolymer such as #42,650-4; #42,781-0; available from Aldrich Chemical Company, poly(propylene-co-1-butene) copolymer such as #42,822-1; available from Aldrich Chemical Company, poly(propylene-co-1-hexene) copolymer such as #42,824-8; available from Aldrich Chemical Company, poly(propylene-co-1-butene-co-ethylene)copolymer such as #42,825-6; available from Aldrich Chemical Company, poly(propylene)-graft-poly(maleic anhydride) copolymer isobutylene-co-isoprene) copolymer such as #874, available from Scientific Polymer Products, epoly(ethylene-co-propylene-co-diene) terpolymer such as

#350, #360, #448, #449 available from Scientific Polymer Products; polydienes and their copolymers including polyisoprene such as #036, #073, available from Scientific Polymer Products, polychloroprene such as #196, #502, #503, #504, available from Scientific Polymer Products, polybutadiene such as #206, #552, #894, available from Scientific Polymer Products, polybutadiene phenyl terminated such as #432, #433, #434, #435, #436, #437, #438, #443, available from Scientific Polymer Products, polybutadiene dicarboxy terminated such as #294, #524, #525, #526, available from Scientific Polymer Products; polystyrene-block-polyisoprene such as #43,246-6; available from Aldrich Chemical Company, polystyrene-block-polybutadiene such as #43,248-2; #43,249-0; available from Aldrich Chemical Company, polystyrene-block-polyisoprene-block-polystyrene such as #43,239-3; #43,240-7; #43,241-5; available from Aldrich Chemical Company, polystyrene-block-poly(ethylene-random-butylene)-block-polystyrene such as #43,245-8; available from Aldrich Chemical Company, vinylalkylether polymers including polyvinylmethylether such as #450, available from Scientific Polymer Products, polyvinylisobutylether such as #425, available from Scientific Polymer Products; polyvinyl esters including poly(vinyl stearate) such as #103, available from Scientific Polymer Products, poly(vinyl propionate) such as #303, available from Scientific Polymer Products, poly(vinyl pivalate) such as #306, available from Scientific Polymer Products, poly (vinyl neodecanoate) such as #267, available from Scientific Polymer Products, poly vinyl acetate such as #346, #347, available from Scientific Polymer Products, low melt polyesters including poly(ethylene adipate) such as #147, available from Scientific Polymer Products, poly(ethylene succinate) such as #149, available from Scientific Polymer Products, poly(ethylene azelate) such as #842, available from Scientific Polymer Products, poly(1,4-butylene adipate) such as #150, available from Scientific Polymer Products, poly(trimethylene adipate) such as #594, available from Scientific Polymer Products, poly(trimethylene glutarate) such as #591 available from Scientific Polymer Products, poly(trimethylene succinate) such as #592, available from Scientific Polymer Products poly(hexamethylene succinate) such as #124 available from Scientific Polymer Products, poly(diallyl phthalate) such as #010 available from Scientific Polymer Products, poly(diallyl isophthalate) such as #011 available from Scientific Polymer Products, poly(vinylidene chloride-co-methyl acrylate) such as #43,040-4; available from Aldrich Chemical Company, poly (vinylidene fluoride-co-hexafluoropropylene) such as #42,716-0; available from Aldrich Chemical Company, poly (chlorotrifluoroethylene) such as #42,691-1; available from Aldrich Chemical Company, as well as blends or mixtures of any of the above. Any mixtures of the above ingredients in any relative amounts can be employed.

In addition, the extrudable backing substrate 98 contains lightfastness inducing agents including UV absorbing compounds including glycerol 4-amino benzoate, available as Escalol 106 from Van Dyk Corporation; resorcinol mono benzoate, available as RBM, from Eastman Chemicals; octyl dimethyl amino benzoate, available as Escalol 507, from Van Dyk Corporation; hexadecyl 3,5-di-tert-butyl-4-hydroxy-benzoate, available as Cyasorb UV-2908, #41,320-8, from Aldrich chemical company; octyl salicylate, available as Escalol 106, from Van Dyk Corporation; octyl methoxy cinnamate, available as Parasol MCX, from Givaudan Corporation; 4-allyloxy-2-hydroxybenzophenone, available as Uvinul 600 #41,583-9, from Aldrich chemical company; 2-hydroxy-4-methoxy benzophenone, available as Anti UVA, from Aceto Chemicals; 2,2'-dihydroxy-4,4'-dimethoxy benzophenone, available as Uvinul D49, #D11,100-7, from Aldrich chemical company; 2-hydroxy-4-(octyloxy)benzophenone, available as Cyasorb UV-531, #41,315-1, from Aldrich chemical company; 2-hydroxy-4-dodecyloxy benzophenone, available as DOBP, from Eastman Chemicals; 2-(2'-hydroxy-5'-methylphenyl)benzotriazole, available as Tinuvin 900, from Ciba Geigy Corporation; 2-[2'-hydroxy-3,5-di-(1,1-dimethyl benzyl)phenyl]-2H-benzo triazole, available as Topanex 100BT, from ICI America Corporation; bis[2-hydroxy-5-tert-octyl-3-(benzotriazol-2-yl) phenyl methane, available as Mixxim BB/100, from Fairmount-Corporation; 2-(3',5'-di-tert-butyl-2'-hydroxyphenyl)-5-chlorobenzotriazole, available as Tinuvin 327, from Ciba Geigy Corporation; 2(4-benzoyl-3-hydroxyphenoxy) ethylacrylate (Cyasorb UV-416, #41,321-6, available from Aldrich chemical company), poly[2-(4-benzoyl-3-hydroxyphenoxy) ethylacrylate] (Cyasorb UV-2126, #41,323-2, available from Aldrich chemical company), N-(4-ethoxycarbonyl phenyl)-N'-ethyl-N'-phenyl formadine, available as Givesorb UV-2, from Givaudan Corporation; 1,1-(1,2-ethane-diyl)-bis(3,3,5,5-tetramethyl piperazinone), available as Good-rite UV 3034, from Goodrich chemicals; tris(3,5-di-tert-butyl-4-hydroxybenzyl)isocyanurate, available as Good-rite UV 3114, from Goodrich-chemicals; nickel-bis(o-ethyl(3,5-di-tert-butyl-4-hydroxybenzyl) phosphonate, available as Irgastab 2002, from Ciba Geigy Corporation; [2,2,6,6-tetramethyl-4-piperidinyl)-1,2,3,4-butane tetra carboxylate, available as Mixxim HALS 57, from Fairmount Corporation; [2,2,6,6-tetramethyl-4-piperidinyl/β,β,β',β'-tetramethyl-3,9-(2,4,8,10-tetraoxospiro-(5,5)undecane)diethyl]-1,2,3,4-butane-tetracarboxylate, available as Mixxim HALS 68, from Fairmount Corporation; [1,2,2,6,6-pentamethyl-4-piperidinyl/β,β,β',β'-tetramethyl-3,9-(2,4,8,10-tetraoxo-spiro(5,5)undecane)diethyl]-1,2,3,4-butane tetracarboxylate, available as Mixxim HALS-63, from Fairmount-Corporation, 2-dodecyl-N-(2,2,6,6-tetramethyl-4-piperidinyl)succinimide, available as Cyasorb UV-3581, #41,317-8, from Aldrich chemical company); 2-dodecyl-N-(1,2,2,6,6-pentamethyl-4-piperidinyl)succinimide, available as Cyasorb UV-3604, #41,318-6, from Aldrich chemical company; N-(1-acetyl-2,2,6,6-tetramethyl-4-piperidinyl)-2-dodecyl-succinimide, available as Cyasorb UV-3668, #41,319-4, from Aldrich chemical company; tetra sodium-N-(1,2-dicarboxyethyl)-N-octadecylsulfosuccinamate, available as Aerosol 22N, from American Cyanamid Corporation; nickel-dibutyldithio-carbamate, available as UV-Chek AM-105, from Ferro Corporation; poly(4-hydroxy-2,2,6,6-tetramethyl-1-piperidine ethanol/dimethyl succinic acid), available as Tinuvin 622LD, from Ciba-Geigy Corporation; poly(3,5-di-tert-butyl-4-hydroxy hydrocinnamic acid ester/1,3,5-tris(2-hydroxyethyl)-5-triazine-2,4,6(1H,3H,5H)-trione, available as Good-rite 3125, from Goodrich Chemicals; poly[N,N-bis(2,2,6,6-tetramethyl-4-piperidinyl)1,6-hexanediamine-co-2,4-dichloro-6 -morpholino-1,3,5-triazine) available as Cyasorb UV-3346, #41,324-0, from Aldrich chemical company; 1-[N-[poly(3-allyloxy-2-hydroxy propyl)-2-aminoethyl]-2-imidazolidinone, #41,026-8, available from Aldrich chemical company; poly(2-ethyl-2-oxazoline) #37,284-6, #37,285-4,#37,397-4, available from Aldrich chemical company.

Further, the extrudable backing substrate 98 contains lightfastness inducing antioxidant compounds such as didodecyl-3,3'-thiodipropionate, available as Cyanox, LTDP, #D12,840-6, from Aldrich chemical company;

ditridecyl-3,3'-thiodipropionate, available as Cyanox 711, #41,311-9, from Aldrich chemical company); ditetradecyl-3,3'-thiodipropionate, available as Cyanox, MTDP, #41,312-7, from Aldrich chemical company; dicetyl-3,3'-thiodipropionate, available as Evanstab 16 from Evans Chemetics Corporation; dioctadecyl-3,3'-thiodipropionate, available as Cyanox, STDP, #41,310-0, from Aldrich chemical company; triethyleneglycol-bis[3-(3'-tert-butyl-4'-hydroxy-5'-methylphenyl)propionate], available as Irganox 245, from Ciba-Geigy Corporation; octadecyl 3-(3,5-di-tert-butyl-4-hydroxyphenyl)propionate, available as Ultranox 276, from General Electric Company; 1,6-hexamethylene-bis(3,5-di-tert-butyl-4-hydroxy hydrocinnamate), available as Irganox 259, from Ciba-Geigy Corporation; tetrakis [methylene(3,5-di-tert-butyl-4-hydroxy hydrocinnamate), available as Irganox 1010, from Ciba-Geigy Corporation; thiodiethylene-bis(3,5-di-tert-butyl-4-hydroxy) hydrocinnamate, available as Irganox 1035, from Ciba-Geigy Corporation; octadecyl-3,5-di-tert-butyl-4-hydroxy hydrocinnamate, available as Irganox 1076, from Ciba-Geigy Corporation; N,N'-hexamethylenebis(3,5-di-tert-butyl-4-hydroxy hydrocinnamide), available as Irganox 1098, from Ciba-Geigy Corporation; 2,2-bis[4-(2-(3,5-di-tert-butyl-4-hydroxyhydrocinnamoyloxy))ethoxy phenyl] propoane, available as Topanol 205, from ICI America Corporation; N-stearoyl-4-aminophenol, available as Sucnox-18, from Hexcel Corporation; 2,6-di-tert-butyl-4-methyl phenol, available as Ultranox 226, from General Electric company; 2,6-di-tert-butyl-4-cresol, available as Vulkanox KB, from Mobay Chemicals; 2,6-di-tert-butyl-a-dimethylamino-4-cresol, available as Ethanox-703, from Ethyl Corporation; 2,2'-isobutylidene-bis(4,6-dimethyl phenol), available as Vulkanox NKF, from Mobay Chemicals; 2,2'-methylenebis(6-tert-butyl-4-methylphenol), available as Cyanox 2246, #41,315-5, from Aldrich chemical company; 2,2'-methylene bis(6-tert-butyl-4-ethylphenol), available as Cyanox 425, #41,314-3, from Aldrich chemical company; tris(4-tert-butyl-3-hydroxy-2,6-dimethylbenzyl) isocyanurate, available as Cyanox 1790, #41,322-4, LTDP, #D12,840-6, from Aldrich chemical company; 1,3,5-trimethyl-2,4,6-tris(3,5-di-tert-butyl-4-hydroxybenzyl) benzene, available as Ethanox 300, #41,328-3, from Aldrich chemical company; triphenyl phosphite, available as Lankromark LE65, from Harcros Corporation; tris (nonyl phenyl) phosphite, available as Lankromark LE109, from Harcros Corporation; tris (2,4-di-tert-butyl-phenyl)phosphite, available as Wytox 240, from Olin Corporation; 2,2-ethylidene-bis(4,6-di-tert-butylphenyl) fluorophosphonite, available as Ethanox 398, from Ethyl Corporation; octylated diphenyl amine, available as Anchor ODPA, from Anchor Corporation; N,N'-β,β'-naphthalene-4-phenylenediamine, available as Anchor DNPD, from Anchor Corporation; 4,4'-methylene-bis(dibutyldithio carbamate), available as Vanlube 7723, from Vanderbilt Corporation; antimony dialkyldithio carbamate, available as Vanlube 73, from Vanderbilt Corporation; antimony-dialkylphosphorodithioate, available as Vanlube 622, from Vanderbilt Corporation; molybdenum oxysulfide dithio carbamate, available as Vanlube 622, from Vanderbilt Corporation; 2,2,4-trimethyl-1,2-hydroquinoline, available as Vulkanox HS, from Mobay Corporation; and mixtures thereof.

Further, the extrudable backing substrate 98 contains lightfastness inducing antiozonants such as N-isopropyl-N'-phenyl-phenylene diamine, available as Santoflex IP, from Monsanto Chemicals; N-(1,3-dimethylbutyl)-N'-phenyl-phenylene diamine, available as Santoflex 13, from Monsanto Chemicals; N,N'-di(2-octyl)-4-phenylene diamine, available as Antozite-1, from Vanderbilt Corporation; N,N-bis (1,4-dimethyl pentyl)-4-phenylene diamine, available as Santoflex 77, from Monsanto Chemicals; 2,4,6-tris-(N-1,4-dimethyl pentyl-4-phenylene diamino)-1,3,5-triazine, available as Durazone 37, from Uniroyal Corporation; 6-ethoxy-1,2-dihydro-2,2,4-trimethyl quinoline, available as Santoflex AW, from Monsanto Chemicals; bis-(1,2,3,6-tetrahydrobenzaldehyde) pentaerythritol acetal, available as Vulkazon AFS/LG, from Mobay Corporation; Parrafin Wax, available as Petrolite C-700, Petrolite C-1035, from Petrolite Corporation; and mixtures thereof.

In addition, the extrudable backing substrate 98 contains at least one luminescent composition capable of generating fluorescence, phosphorescence or chemiluminescence phenomenon and selected from the group consisting of Inorganic powder Phosphors derived from calcium halophosphate, barium magnesium aluminate, magnesium aluminate, strontium chloropatite, zinc silicate and the oxides, oxysulfides, phosphates, vanadates and silicates of yttrium, gadolinium or lanthanum. Commonly used activators are rare-earth ions such as europium II and III, terbium II, cerium II, and tin II. Fluorescent chemical compounds that convert uv radiation to visible radiation at the blue end of the spectrum and known as fluorescent whitening agents or optical brightners are derived from stilbene, coumarine and naphthalimide. Other fluorescent brightners are derived from fluorescent dyes as well as polymeric dyes such as polymeric phthalocyanines, and the like. Commercially sold pigment colors are dispersed in polymers such as polyamide or Triazine-aldehyde-amide and are available from Day-Glo Color Corp such as Day-Glo-A-Series including A-17-N saturn yellow, A-18-N signal yellow; A-16-N arc yellow; A-15-N blaze orange; A-14-N fire orange; A-13-N rocket red; A-12 neon red; A-11 aurora pink; A-21 corona magenta; A-19 horizon blue; also included are materials from the Day-Glo-D-Series; Day-Glo-T-Series; Day-Glo-AX-Series; Day-Glo-SB-Series; DayGlo-HM-Series; Day-Glo-HMS -Series; those dispersed in polyester or Triazine-aldehyde-amide are available from Radiant Color Corp. including Radiant R-105-Series; including R-105-810 chartreuse; R-105-811 green; R-105-812 orange-yellow; R-105-813 orange; R-105-814 orange-red; R-105-815 red; R-105-816 cerise; R-105-817 pink; R-103-G-118 magenta; R-103-G-119 blue; also included are materials from the R-203-G-series; R-P-1600-series; R-P-1700-series; R-XRB-series; R-K-500 series; and visiprint-series; those dispersed in Triazine-aldehyde-amide are available from Lawter Chemicals including Lawter-B-Series including B-3539 lemon yellow; B-3545 green; B-3515 gold yellow; B-3514 yellow orange; B-3513 red orange; B-3534 red; B-3530 cerise red; B-3522 pink; B-3554 magenta; B-3556 vivid blue; also included are materials from the Lawter-G-3000-Series; Lawter-HVT-Series; are very suitable for the present application. Inorganic powder phosphors, polymer dispersed organic pigment phosphors as well as monomeric or polymeric dye based phosphors can be applied to various substrates via solvent coatings where the phosphor is compounded with a polymer and dispersed or dissolved in a solvent such as ethanol, esters, ketones, glycol ethers and water. The use of solvents such as ethanol and water is preferred because these are less toxic. Radiant polyester pigments are preferred for the present application as these have a softening temperature of 110° C. The higher softening temperature of polyamide (150° C.) and Triazine-aldehyde-amide (128° C. to 145° C.) pigments requires more heat for their lamination to other substrates.

In addition, the extrudable backing substrate 98 contains plasticizers having a melting point of less than 75° C. and selected from the group comprising: bis (4-nitrobenzyl) phosphite (Aldrich 29,367-9), triphenyl phosphate (Aldrich 24,128-8), triphenyl ethylene (Aldrich T8,280-5), tripalmitin (Aldrich 23,471-0), trihexyl trimellitate (Aldrich 38,899-8), trioctyl trimellitate (Aldrich 36,860-1), tropine hydrate (Aldrich T8,940-0), tropinone (Aldrich T8,9605), tropolone (Aldrich T8,970-2), tropane (Aldrich 37,870-4), 2-vinyl naphthalene (Aldrich V 290-9), vinylene trithiocarbonate (Aldrich 35,891-6), 9-vinyl anthracene (Aldrich V 170-8), (S)-cis-verbenol (Aldrich 24,706-5),(1S)-(−)-verbenone (Aldrich 41,995-8; Aldrich 21,825-1), tryptophol (Aldrich T9,0301), triacetin (Aldrich 24,088-5), tiglic acid (Aldrich T3,520-3), thymoquinone (Aldrich 27,466-6), thymol (Aldrich 11,209-7), thio phenoxyacetic acid (Aldrich T3,300-6), 2,2,4-trimethyl-1,3-pentane dioldiisobuyrate (Aldrich 36,865-2), 1,5-pentamethylene tetrazole (Aldrich P720-7), bispentamethylene urea (Aldrich B5,045-7), quinoxaline (Aldrich Q,160-3), quinoline N-oxide hydrate (Aldrich 12,232-7), quinoline carboxaldehyde (Aldrich 33,425-1), quinazoline (Aldrich 12,332-3), quinaldine (Aldrich Q, 80-9), pyrrole-2-carboxaldehyde (Aldrich P7,340-4), 4-propoxy phenol (Aldrich 23,067-7), triallyl-1,3,5-triazine-2,4,6-trione (Aldrich 11,423-5), 2,4,6-triallyloxy-1,3,5-triazine (Aldrich 29,160-9), 1,2,3,4-tetrahydroquinoline (Aldrich T1,550-4), tetradecanophenone (Aldrich 31,9783), tridecyl methacrylate (Aldrich 40,834-4), tricyclo[5.2.1.0]decane (Aldrich 16,427-5), trimethyl cis, cis-1,3,5-cyclohexene tricarboxylate (Aldrich 36,229-8), trimethyl 1,2,4-benzenetricarboxylate (Aldrich 23,531-8), sorbitan monopalmitate (Aldrich 38,892-0),sorbitan monostearate (Aldrich 31,822-1), tetramethyl ammoniumfluoride tetrahydrate (Aldrich 10,721-2); and mixtures thereof.

Other plasticizers such as those disclosed in U.S. Pat. No. 5,118,570 (Malhotra), U.S. Pat. No. 5,006,407 (Malhotra), U.S. Pat. No. 5,451,466 (Malhotra) U.S. Pat. No. 5,451,458 (Malhotra) U.S. Pat. No. 5,302,439 (Malhotra and Bryant) the disclosures of each of which are totally incorporated herein by reference.

In addition, the extrudable backing substrate 98 contains light color pigment components which exhibit a light color. Pigments can be present in any effective amount, and if present, typically are present in amounts of from about 1 to about 75 percent by weight of the coating composition. Examples of pigment components include zirconium oxide (SF-EXTRA available from Z-Tech Corporation), colloidal silicas, such as Syloid 74, available from Grace Company (preferably present, in one embodiment, in an amount of from about 10 to about 70 percent by weight percent), titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blend of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof. Brightener pigments can enhance color mixing and assist in improving print-through in recording sheets of the present invention.

In one embodiment, in the fluorescent thermoplastic extrudable backing substrate 98 the extrudable polymer or mixture thereof are present in amounts of from about 58.5 percent by weight to about 9 percent by weight, the fluorescent composition or mixture thereof are present in amounts of from about 0.5 percent by weight to about 30 percent by weight, the antistatic agent or mixture thereof are present in amounts of from about 0.5 percent by weight to about 10 percent by weight, the lightfastness inducing compounds or mixture thereof are present in amounts of from about 10 percent by weight to about 0.5 percent by weight, the plasticizer or mixture thereof are present in the in amounts of from about 30 percent by weight to about 0.5 percent by weight, the fillers or mixture thereof are present in amounts of from about 0.5 percent by weight to about 50 percent by weight.

The thickness of the fluorescent thermoplastic extrudable backing substrate is from about 25 to about 500 microns.

The metals that can be employed in metallic mirror coatings 97 on one surface of the extruded fluorescent backing substrate 98 can be selected from the group consisting of: rubidium, cesium, beryllium, magnesium, calcium, barium, strontium, aluminum, scandium, titanium, vanadium, chromium, manganese, iron, cobalt, nickel, copper, zinc, gallium, germanium, yttrium, zirconium, niobium, molybdenum, rubidium, rhodium, palladium, silver, cadmium, indium, tin, antimony, lanthanum, halfnium, tantalum, tungsten, rhenium, osmium, iridium, platinum, gold, mercury, thallium, lead, bismuth, terbium, selenium, tellurium, ruthenium, neodymium, thulium, and the like, all being available commercially.

The thickness of the metallic coating 97 present on the backing substrate 98 is from about 0.1 to about 25 microns.

The coating compositions discussed above can be applied to the substrate by any suitable technique. For example, the coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In the multilayer slot coating, the coating solutions form a liquid stack in the gap where the liquids come in the contact with the moving web to form a coating. The stability of the interface between the two layers depends on wet thickness, density and viscosity ratios of both layers which need to be kept as close to one as possible. Once the desired amount of coating has been applied to the web, the coating is dried, typically at from about 25° to about 100° C. in an air drier.

The extrudable backing substrate of the present invention can be prepared by melt-forming processes encompassing calendering and various methods of extrusion such as blown bubble, slot-die casting and coating on a substrate as disclosed in the Encyclopedia of Chemical Technology Vol 10, PP 234–245, 1978, A Wiley-Interscience Publication, the disclosure of which is totally incorporated herein by reference. In calendering a continuous film is formed by squeezing a thermoplastic material between two or more horizontal metal rolls. The composition comprised of (1) a thermoplastic polymer, such as polyethylene such as #041, #042, #535, #536, #558, #560, available from Scientific Polymer Products, polypropylene such as #130, #780, #781, #782, #783, available from Scientific Polymer Products, poly(1-butene) such as #128, #337, #338, available from Scientific Polymer Products, poly(isobutylene) such as #040A, #040B, #040E,#668, #681, #683, #684, available from Scientific Polymer Products; (2) fluorescent brightners that are derived from fluorescent dyes as well as polymeric dyes such as polymeric phthalocyanines, and the like; (3) plasticizers having a melting point of less than 75° C. and selected from the group comprising bis (4-nitrobenzyl) phosphite (Aldrich 29,367-9), triphenyl phosphate (Aldrich 24,128-8), triphenyl ethylene (Aldrich T8,280-5), tripalmitin (Aldrich 23,471-0), trihexyl trimellitate (Aldrich 38,899-8), trioctyl trimellitate Aldrich 36,860-1) and the like; (4) lightfastness inducing agents including UV absorbing compounds including 2-(4-benzoyl-3-hydroxyphenoxy)ethylacrylate (Cyasorb UV-416, #41,321-6, available from Aldrich chemical company), 2-hydroxy-4-(octyloxy)benzophenone (Cyasorb UV-531, #41,315-1, available from Aldrich chemical company), antioxidant and antiozonant compounds such as 2,2'-methylenebis(6-tert-butyl-4-methylphenol)(Cyanox 2246, #41,315-5, available from Aldrich chemical company), 2,2'-methylenebis(6-tert-butyl-4-ethylphenol) (Cyanox 425, #41,314-3, available from Aldrich chemical company); (5) antistatic agents including both anionic and cationic materials, such as anionic antistatic components derived from monoester sulfosuccinates, diester sulfosuccinates and sulfosuccinamates and cationic antistatic components derived from quaternary salts; quaternary acrylic copolymer latexes; ammonium quaternary salts as disclosed in U.S. Pat. No. 5,320,902 (Malhotra et al); (6) and fillers such as blend of calcium fluoride and silica, such as Opalex-C available from Kemira,O.Y, zinc oxide, such as Zoco Fax 183, available from Zo Chem, blends of zinc sulfide with barium sulfate, such as Lithopane, available from Schteben Company, and the like; is compounded into a plastic mass and fed to the top rolls of the calender. The mass passes through successive nip rolls which mix it and reduce it in thickness. Further reduction in thickness may be effected by overdriving the film web take-off rolls (running those rolls faster than the calender rolls) to stretch the web before it cools. Surface finish of the film is controlled by the finish on the calender rolls or by the use of the embossing rolls following the calender rolls. The film is then cooled, slit to the desired width, and wound on the cores.

Laminated imaged substrates of the present invention exhibit reduced curl upon being printed with toners/liquid inks. Generally, the term "curl" refers to the distance between the base line of the arc formed by the imaged substrate when viewed in cross-section across its width (or shorter dimension—for example, 8.5 inches in an 8.5 by 11 inch sheet, as opposed to length, or longer dimension—for example, 11 inches in an 8.5 by 11 inch sheet) and the midpoint of the arc. To measure curl, a sheet can be held with the thumb and forefinger in the middle of one of the long edges of the sheet (for example, in the middle of one of the 11 inch edges in an 8.5 by 11 inch sheet) and the arc formed by the sheet can be matched against a pre-drawn standard template curve.

The gloss values recited herein were obtained on a 75° Glossmeter, Glossgard II from Pacific Scientific (Gardner/Neotec Instrument Division).

The optical density measurements recited herein were obtained on a Pacific Spectrograph Color System. The system consists of two major components, an optical sensor and a data terminal. The optical sensor employs a 6 inch integrating sphere to provide diffuse illumination and 2 degrees viewing. This sensor can be used to measure both transmission and reflectance samples. When reflectance samples are measured, a specular component may be included. A high resolution, full dispersion, grating monochromator was used to scan the spectrum from 380 to 720 nanometers (nm). The data terminal features a 12 inch CRT display, numerical keyboard for selection of operating parameters, and the entry of tristimulus values, and an alphanumeric keyboard for entry of product standard information. The print through value as characterized by the printing industry is Log base 10 (reflectance of a single sheet of unprinted paper against a black background/reflectance of the back side of a black printed area against a black background) measured at a wavelength of 560 nanometers.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Preparation of fluorescent thermoplastic backing substrates 98 followed by deposition of coating 97 on backing substrates 98:

Twenty fluorescent thermoplastic backing substrates in a thickness of 75 microns each were prepared by melt-forming at 150° C. using slot-die casting followed by calendering of a composition comprised of (1) 60 percent by weight of thermoplastic polymer, polyethylene, #560, available from Scientific Polymer Products, (2) 5 percent by weight, fluorescent brightner Day-Glo-A-18-N signal yellow; (3), plasticizer bis (4-nitrobenzyl) phosphite (Aldrich 29,367-9), (4) lightfastness inducing agents: 2 percent by weight, UV absorbing compound 2-(4-benzoyl-3-hydroxyphenoxy) ethylacrylate (Cyasorb UV-416, #41,321-6, available from Aldrich chemical company), 2 percent by weight, antioxidant compound 2,2'-methylene-bis(6-tert-butyl-4-methylphenol)(Cyanox 2246, #41,315-5, available from Aldrich chemical company), and 1 percent by weight, antiozonant compound N,N'-di(2-octyl)-4-phenylene diamine, available as Antozite-1, from Vanderbilt Corporation, (5) 5 percent by weight, antistatic agent, Alkasurf SS-L7DE, commercially available from Alkaril Chemicals, (6) and 20 percent by weight Opalex-C, filler {(blend of calcium fluoride and silica}, available from Kemira, O.Y. These fluorescent thermoplastic backing substrates 98 were further deposited with 0.5 microns of the metallic mirror coating 97 of silver metal. The fluorescent thermoplastic backing substrates containing metallic silver mirror coating were cut from this roll in 8.5 by 11.0 inches cut sheets.

Preparation of the xerographic images on transparencies containing coating 99:

Transparencies were prepared by a dip coating process (both sides coated in one operation) by providing Mylar® (8.5 by 11 inches) in a thickness of 100 microns and coating them with blends of an 80 percent by weight binder resin, polyester latex (Eastman AQ 29D), 18 percent by weight, (±)-β,β-dimethyl-γ-(hydroxymethyl)-γ-butyrolactone, (Aldrich #26,496-2), 1 percent by weight antistatic agent D,L-carnitinamide hydrochloride (Aldrich 24,783-9), and 1 percent by weight of a traction agent colloidal silica, Syloid 74, obtained from W. R. Grace & Co., which blend was present in water solution in a concentration of 25 percent by weight, as described in the U.S. Pat. No. 5,451,458 with the named inventor Shadi L. Malhotra, entitled "Recording Sheets" the disclosure of which is totally incorporated herein by reference. The coated Mylar® transparencies were then dried in a vacuum hood for one hour. Measuring the difference in weight prior to and subsequent to coating these transparencies indicated an average coating weight of about 300 milligrams on each side in a thickness of about 3 microns. 20 of these transparencies were fed into a Xerox 5775™ color copier and images were obtained having optical density values of 1.25 (cyan), 1.10 (magenta), 0.75 (yellow) and 1.40 (black).

Lamination of imaged transparencies containing coating 99 with the fluorescent thermoplastic backing substrates 98 containing metallic silver mirror coating 97:

The imaged side of the transparency was brought in contact with the fluorescent metallic silver mirror coating side of the backing substrate and laminated together at 150° C. and a pressure of 100 psi for 2 minutes in a Model 7000 Laminator from Southwest Binding Systems, Ontario, Canada. The laminated structure of transparency and plastic had a gloss of 150 units, and enhanced optical density images that were right reading images in a luminescent reflective mirror background. These images were lightfast for a period of six months without any change in their optical density.

EXAMPLE II

Preparation of fluorescent thermoplastic backing substrates 98 followed by deposition of coating 97 on backing substrates 98:

Twenty fluorescent thermoplastic backing substrates in a thickness of 75 microns each were prepared by melt-forming at 150° C. using slot-die casting followed by calendering of a composition comprised of (1) 60 percent by weight of a thermoplastic polymer, polypropylene #130, available from Scientific Polymer Products, (2) 5 percent by weight of fluorescent brightner Radiant R-105-810 chartreuse, (3) 5 percent by weight of plasticizer, 2,4,6-triallyloxy-1,3,5-triazine (Aldrich 29,160-9), (4) lightfastness inducing agents: 2 percent by weight, UV absorbing compound poly[N,N-bis(2,2,6,6-tetramethyl-4-piperidinyl)1,6-hexanediamine-co-2,4-dichloro-6-morpholino-1,3,5-triazine), (Cyasorb UV-3346, #41,324-0, available from Aldrich chemical company), 2 percent by weight, antioxidant compound molybdenum oxysulfide dithio carbamate, available as Vanlube 622, from Vanderbilt Corporation, and 1 percent by weight, antiozonant compound N-(1,3-dimethylbutyl)-N'-phenyl-phenylene diamine, available as Santoflex 13, from Monsanto Chemicals, (5) 5 percent by weight, antistatic agent Alkasurf SS-DA4-HE, commercially available from Alkaril Chemicals, 6) and 20 percent by weight Lithopane filler, {blend of zinc sulfide with barium sulfate}, available from Schteben Company. These fluorescent thermoplastic backing substrates 98 were further deposited with 0.5 microns of the metallic mirror coating 97 of aluminum metal. The fluorescent thermoplastic backing substrates containing metallic aluminum mirror coating were cut from this roll in 8.5 by 11.0 inch cut sheets.

Preparation of ink jet ink images on transparencies containing coating 99:

Transparency sheets containing hydrophilic ink receiving layers were prepared as follows as described in a copending application U.S. Ser. No. (not yet assigned); Attorney Docket No. D/93601), with the named inventor Shadi L. Malhotra, entitled "Recording Sheets containing Oxazole, Isooxazole, Oxazolidinone, Oxazoline Salt, Morpholine, Thiazole, Thiazolidine, Thiadiazole, and Phenothiazine Compounds" the disclosure of which is totally incorporated herein by reference. Blends of 54 percent by weight hydroxypropyl methyl cellulose (K35LV, obtained from Dow Chemical Co.), 36 percent by weight poly(ethylene oxide) (POLY OX WSRN-3000, obtained from Union Carbide Corp., and 10 percent by weight of additive 4-morpholine propane sulfonic acid obtained from Aldrich Chemical Co., were prepared by mixing 43.2 grams of hydroxypropyl methyl cellulose, 28.8 grams of poly(ethylene oxide), and 8 grams of the 4-morpholine propane sulfonic acid in 1,000 milliliters of water in a 2 Liter jar and stirring the contents in an Omni homogenizer for 2 hours. Subsequently, the solution was left overnight for removal of air bubbles. The blends thus prepared were then coated by a dip coating process (both sides coated in one operation) by providing Mylar® base sheets in cut sheet form (8.5 by 11 inches) in a thickness of 100 microns. Subsequent to air drying at 25° C. for 3 hours followed by oven drying at 100° C. for 10 minutes and monitoring the difference in weight prior to and subsequent to coating, the dried coated transparencies contained 1 gram, 10 microns in thickness of the ink receiving layers, on each surface (2 grams total coating weight for 2-sided transparency) of the substrate.

The transparencies thus prepared were incorporated into a color ink jet printer equipped with [wrong reading] reverse image writing capability and containing inks of the following compositions:

Cyan: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl)aminomethane obtained from Aldrich Chemical company, 0.35 percent by weight EDTA (ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 35 percent by weight Projet Cyan 1 dye, obtained from ICI, 34.285 percent by weight deionized water.

Magenta: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl) aminomethane obtained from Aldrich Chemical company, 0.35 percent by weight EDTA (ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 25 percent by weight Projet magenta 1T dye, obtained from ICI, 4.3 percent by weight Acid Red 52 obtained from Tricon Colors, 39.985 percent by weight deionized water.

Yellow: 15.785 percent by weight sulfolane, 10.0 percent by weight butyl carbitol, 2.0 percent by weight ammonium bromide, 2.0 percent by weight N-cyclohexylpyrollidinone obtained from Aldrich Chemical company, 0.5 percent by weight Tris(hydroxymethyl)aminomethane obtained from Aldrich Chemical company, 0.35 percent by weight EDTA (ethylenediamine tetra acetic acid) obtained from Aldrich Chemical company, 0.05 percent by weight Dowicil 150 biocide, obtained from Dow Chemical Co., Midland, Mich., 0.03 percent by weight polyethylene oxide (molecular weight 18,500), obtained from Union Carbide Co.), 27.0 percent by weight Projet yellow 1G dye, obtained from ICI, 20.0 percent by weight Acid yellow 17 obtained from Tricon Colors, 22.285 percent by weight deionized water.

Images were generated having optical density values of 1.40 (cyan), 1.17 (magenta), 0.80 (yellow) and 1.75 (black).

Lamination of imaged transparencies containing coating 99 with the fluorescent thermoplastic backing substrates 98 containing metallic aluminum mirror coating 97:

The imaged side of the transparency was brought in contact with the fluorescent metallic aluminum mirror coating side of the backing substrate and laminated together at 150° C. and a pressure of 100 psi for 2 minutes in a Model 7000 Laminator from Southwest Binding Systems, Ontario, Canada. The laminated structure of transparency and plastic had a gloss of 155 units, and enhanced optical density images that were right reading images in a luminescent reflective mirror background. These images were lightfast for a period of six months without any change in their optical density.

EXAMPLE III

Preparation of fluorescent thermoplastic backing substrates 98 followed by deposition of coating 97 on backing substrates 98:

Twenty fluorescent thermoplastic backing substrates were prepared by melt-forming at 150° C. using slot-die casting followed by calendering of a composition comprised of (1) 60 percent by weight, thermoplastic polymer, poly(1-butene) #128, available from Scientific Polymer Products, (2) 5 percent by weight) fluorescent brightner, Lawter-B-Series B-3545 green, (3) 5 percent by weight, plasticizer tropinone (Aldrich T8,960-5), (4) lightfastness inducing agents: 2 percent by weight UV absorbing compound, poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich chemical company), 1 percent by weight antioxidant, 2,2'-ethylidene-bis(4,6-di-tertbutylphenyl) fluorophosphonite, available as Ethanox 398, from Ethyl Corporation, and 2 percent by weight, antiozonant compound 2,4,6-tris-(N-1,4-dimethyl pentyl-4-phenylene diamino)-1,3,5-triazine, available as Durazone 37, from Uniroyal Corporation, (5) 5 percent by weight antistatic agent quaternary acrylic copolymer latex HX42-1 commercially available from Interpol corporation, (6) 20 percent by weight filler Lithopane, {blend of zinc sulfide with barium sulfate}, available from Schteben Company. These fluorescent thermoplastic backing substrates 98 were further deposited with 0.5 microns of the metallic mirror coating 97 of tin metal. The fluorescent thermoplastic backing substrates containing metallic tin mirror coating were cut from this roll in 8.5 by 11.0 inch cut sheets.

Preparation of the xerographic images on transparencies containing coating 99:

20 sheets of Fuji Xerox COLOR OHP Transparency were fed into a Fuji Xeroxcolor copier and images were obtained having optical density values of 1.20 (cyan), 1.15 (magenta), 0.77 (yellow) and 1.35 (black).

Lamination of imaged transparencies containing coating 99 with the fluorescent thermoplastic backing substrates 98 containing metallic tin mirror coating 97:

The imaged side of the Fuji Xerox COLOR OHP Transparency was brought in contact with the metallic tin mirror coating side of the backing substrate and laminated together at 150° C. and a pressure of 100 psi for 2 minutes in a Model 7000 Laminator from Southwest Binding Systems, Ontario, Canada. The laminated structure of transparency and plastic had a gloss of 155 units, and enhanced optical density images that were right reading images in a luminescent reflective mirror background. These images were lightfast for a period of six months without any change in their optical density.

Other embodiments and modifications of the present invention may occur to those skilled in the art subsequent to a review of the information presented herein, these embodiments and modifications, as well as equivalents thereof, are also included within the scope of this invention.

What is claimed is:

1. A method of creating simulated photographic-quality prints using non-photographic imaging, including the steps of:

providing a coated transparent substrate having a toner image formed thereon using a non-photographic imaging process;

providing the surface of a backing substrate derived from a composition that can be melt formed and extruded in to a self supporting film and is comprised of a blend consisting of (1) a thermoplastic polymer, (2) a fluorescent brightner, (3) plasticizers having a melting point of less than 75° C., (4) lightfastness inducing agent, (5) antistatic agent and (6) filler, melt formed and extruded in to a self supporting film providing a metallic coating on one side covering from about 60 to about 90 percent surface of the self supporting film adhering the coated transparent substrate having the toner image to the metallized film.

2. The method according to claim 1 wherein the metallic coatings are derived from the group of materials consisting of: rubidium, cesium, beryllium, magnesium, calcium, barium, strontium, aluminum, scandium, titanium, vanadium, chromium, manganese, iron, cobalt, nickel, copper, zinc, gallium, germanium, yttrium, zirconium, niobium, molybdenum, rubidium, rhodium, palladium, silver, cadmium, indium, tin, antimony, lanthanum, halfnium, tantalum, tungsten, rhenium, osmium, iridium, platinum, gold, mercury, thallium, lead, bismuth, terbium, selenium, tellurium, ruthenium, neodymium, thulium; and mixtures thereof.

3. The method according to claim 2 wherein said step of providing a coated transparent substrate comprises providing a coated substrate containing a wrong reading formed image.

4. The method according to claim 3 wherein said step of providing a substrate comprises selecting a substrate from the group consisting of (1) polyesters, such as Melinex® (2) polyethylene naphthalates, (3) polycarbonates, (4) polysulfones, (5) polyether sulfones, (6) poly (arylene sulfones), (7) cellulose triacetate, (8) polyvinylchloride, (9) cellophane, (10) polyvinyl fluoride, (11) polypropylene, (12) polyimides, (13) Teslin® (14) opaque Mylar® (15) Diazo papers, and (16) coated photographic papers.

5. The method according to claim 4 wherein said at least a first coating on the transparent substrate is comprised of from about 98.5 percent by weight to about 55 percent by weight of the binder or mixture thereof, from about 0.5 percent by weight to about 20 percent by weight of the antistatic agent or mixture thereof, from about 0.5 percent by weight to about 20 percent by weight of the lightfastness inducing agent or mixture thereof from about 0.5 percent by weight to about 5 percent by weight of the filler or mixture thereof.

6. The method according to claim 5 wherein said step of providing said coated transparent substrate having a toner image formed thereon is coated with a water soluble binder selected from the group consisting of (1) melamine-formaldehyde resin, (2) urea-formaldehyde resin, (3) alkylated urea-formaldehyde resins, (4) vinyl methyl ether-maleic anhydride copolymer, (5) ethylene-maleic anhydride copolymers, (6) butadiene-maleic acid copolymers, (4) octadecene-1-maleic anhydride copolymer (7) polyvinylmethylether (8) vinylmethylether-maleic acid copolymer, (9) methyl vinyl ether-maleic acid ester; as well as mixtures thereof.

7. The method according to claim 6 wherein said step of providing said coated transparent substrate having a toner image formed thereon is coated with a solvent soluble binder selected from the group consisting of: (1) ethylcellulose, (2) poly(2-hydroxyethylmethacryate), (3) poly(2-hydroxyethylacrylate), (4) poly(hydroxypropylacrylate), (5) hydroxyethyl cellulose acrylate, (6) hydroxyethyl cellulose methacrylate, (8) poly(methyl acrylate), (9) poly(ethyl acrylate), (10) poly(n-propyl acrylate), (11) poly(isopropyl acrylate), (12) poly(n-butyl acrylate), (13) poly(tert-butyl acrylate), (14) poly(2-methoxy ethyl acrylate), (15) poly (benzyl acrylate), (16) poly(n-hexyl acrylate), (17) poly(2-ethylhexyl acrylate), (18) poly(octyl acrylate), (19) poly (isooctylacrylate), (20) poly(decylacrylate), (21) poly (isodocyl acrylate), (22) poly(lauryl acrylate), (23), poly (cyclohexyl acrylate), (24) poly(octadecyl acrylate), (25) poly(n-propyl methacrylate), (26) poly(n-butyl methacrylate), (27) poly(n-butyl methacrylate-co-isobutylmethacrylate), (28) poly(tert-butylaminoethyl methacrylate), (29) poly(n-hexyl methacrylate), (30) poly (2-ethylhexyl methacrylate), (31) poly(n-decyl methacrylate), (32) poly(isodecyl methacrylate), (33) poly (lauryl methacrylate), (34) poly(octadecyl methacrylate).

8. The method according to claim 7 wherein said step of providing said coated transparent substrate having a toner image formed thereon is coated with a water soluble binder selected from the group consisting of: (1) poly (ethyleneoxide), (2) ethyleneoxide/propyleneoxide copolymers, (3) ethyleneoxide/2-hdyroxyethylmethacrylate/ethyleneoxide, (4) ethyleneoxide/hydroxypropylmethacrylate/ethylene oxide triblock copolymers, (5) ionene/ethylene oxidefionene triblock copolymers, (6) ethylene oxide/isoprene/ethylene oxide triblock copolymers, (7) epichlorohydrin-ethylene oxide copolymer; and mixtures thereof.

9. The method according to claim 4 wherein said step of providing said coated transparent substrate having a toner image formed thereon includes an antistatic agent selected form the group consisting of (1) monoester sulfosuccinates, (2) diester sulfosuccinates, (3) sulfosuccinamates, (4) ammonium quaternary salts, (5) phosphonium quaternary salts, (6) sulfonium quaternary salts, (7) thiazolium quaternary salt, (8) benzothiazolium quaternary salts; and mixtures thereof.

10. A method according to claim 4 wherein the lightfastness inducing agents of the first layer on the transparent substrate are selected form the group consisting of (1) 2-(4-benzoyl-3-hydroxyphenoxy)ethylacrylate), (2), 2-hydroxy-4-(octyloxy)benzophenone, (3) poly[2-(4-benzoyl-3-hydroxyphenoxy) ethylacrylate], (4) hexadecyl-3,5-di-tert-butyl-4-hydroxy-benzoate, (5) poly[N,N-bis(2,2,6,6-tetramethyl-4-piperidinyl)-1,6-hexanediamine-co-2,4-dichloro-6-morpholino-1,3,5-triazine), (6) 2-dodecyl-N-(2,2,6,6-tetramethyl-4-piperidinyl) succinimide, (7) 2-dodecyl-N-(1,2,2,6,6-pentamethyl-4-piperidinyl) succinimide, (8) N-(1-acetyl-2,2,6,6-tetramethyl-4-piperidinyl)-2-dodecylsuccinimide, (9) 1-[N-[poly(3-allyloxy-2-hydroxypropyl)-2-aminoethyl]-2-imidazolidinone, (10) poly(2-ethyl-2-oxazoline); and mixtures thereof.

11. The method according to claim 4 wherein the filler materials of the of the first layer on the transparent substrate are selected form the group consisting of (1) zirconium oxide, (2) colloidal silicas, (3) titanium dioxide, (4) hydrated alumina, (5) barium sulfate, (6) calcium carbonate, (7) high brightness clays, (8) calcium silicate, (9) cellulosics, (10) blend of calcium fluoride and silica, (11) zinc oxide, (12) blends of zinc sulfide with barium sulfate; and mixtures thereof.

12. The method according to claim 4 wherein the thickness of said at least a first coating in contact with the transparent substrate is from about 0.1 to about 25 microns.

13. A method according to claim 12 wherein, the thermoplastic polymers of the extrudable backing substrate are selected form the group consisting of (1) polyethylene (2) polypropylene, (3) poly(1-butene), (4) poly(isobutylene), (5) poly (propylene-co-ethylene) (6)poly (ethylene-co-1-butene) (7) poly(ethylene-co-1butene-co-1-hexene), (8) poly(ethylene-co-methylacrylate), (9) poly(ethylene-co-methylacrylate-co-glycidyl methacrylate), (10) poly (ethylene-co-ethylacrylate), (11) poly(ethylene-co-ethylacrylate-co-maleic anhydride), (12) poly(ethylene-cobutylacrylate), (13) poly(ethylene-co-butylacrylate-co-carbon monoxide), (14), poly(ethylene-co-glycidylyl methacrylate), (15) poly(ethylene-co-carbon monoxide), (16), poly(ethylene-co-acrylic acid), (17) poly(ethylene-co-acrylic acid) copolymer sodium salt (18), poly(ethylene-co-acrylic acid) copolymer zinc salt, (19) poly(ethylene-co-methacrylic acid), (20) poly(ethylene-co-methacrylic acid) copolymer lithium salt (21), poly(ethylene-co-methacrylic acid) copolymer sodium salt (22), poly(ethylene-co-methacrylic acid) copolymer zinc salt, (23) poly(ethylene-co-vinyl acetate-co-methacrylic acid), (24) poly(ethylene-covinylacetate-co-carbon monoxide), (25) poly(ethylene-co-vinyl acetate)-graft-poly(maleic anhydride), (26) poly (ethylene)-graft-poly(maleic anhydride), (27) poly (propylene-co-1-butene), (28) poly(propylene-co-1-hexene), (29) poly(propylene-co-1-butene-co-ethylene), (30) poly(propylene)-graft-poly(maleic anhydride), (31) poly(isobutylene-co-isoprene), (32) poly(ethylene-co-propylene-co-diene) terpolymer, (33) polyisoprene, (34) polychloroprene, (35) polybutadienephenyl terminated (36) polybutadiene dicarboxy terminated, (37) polystyrene-block-polyisoprene, (38) polystyrene-block-polybutadiene, (39) polystyrene-blockpolyisoprene-block-polystyrene, (40) polystyrene-block-poly(ethylene-random-butylene)-block-polystyrene, (41) polyvinylmethylether, (42) polyvinylisobutyl ether, (43) octadecene-1-maleic anhydride copolymer, (44) poly(vinyl stearate), (45) poly(vinyl propionate), (46) poly(vinyl pivalate), (47) poly(vinyl neodecanoate), (48) poly(vinylacetate), (49) poly(ethylene adipate), (50) poly(ethylene succinate), (51) poly (ethyleneazelate), (52) poly(1,4-butylene adipate) (53) poly (trimethylene adipate), (54) poly(trimethylene glutarate), (55) poly(trimethylene succinate), (56) poly(hexamethylene succinate), (57) poly(diallyl phthalate), (58) poly(diallyl isophthalate), (59) poly(vinylidene chloride-c-methyl acrylate) (60) poly(vinylidene fluoride-co-hexafluoropropylene); and mixtures thereof.

14. A method according to claim 12 wherein the luminescent materials of the extrudable backing substrate are selected form the group consisting of inorganic phosphors, organic phosphors and polymeric phosphors.

15. A method according to claim 12 wherein the lightfastness inducing agents of the extrudable backing substrate are selected form the group consisting of (1) 2-(4-benzoyl-3-hydroxyphenoxy)ethylacrylate), (2), 2-hydroxy-4 (octyloxy) benzophenone, (3) poly[2-(4-benzoyl-3-hydroxyphenoxy)ethylacrylate], (4) hexadecyl-3,5-di-tert-butyl-4-hydroxy-benzoate, (5) poly[N,N-bis(2,2,6,6-tetramethyl-4-piperidinyl)-1,6-hexanediamine-co-2,4-dichloro-6-morpholino-1,3,5-triazine), (6) 2-dodecyl-N-(2,2,6,6-tetramethyl-4-piperidinyl) succinimide, (7) 2-dodecyl-N-(1,2,2,6,6-pentamethyl-4-piperidinyl)succinimide (8) N-(1-acetyl-2,2,6,6-tetramethyl-4-piperidinyl)-2-dodecylsuccinimide, (9) 1-[N-[poly(3-allyloxy-2-hydroxypropyl)-2-aminoethyl]-2-imidazolidinone, (10) poly(2-ethyl-2-oxazoline); and mixtures thereof.

16. The method according to claim 12 wherein the plasticizer materials of the extrudable backing substrate are selected form the group consisting of (1) bis(4-nitrobenzyl) phosphite, (2) triphenyl phosphate, (3) triphenyl ethylene, (4) tripalmitin, (5) trihexyl trimellitate, (6) trioctyl trimellitate, (7) tropine hydrate, (8) tropinone, (9) tropolone, (10) tropane, (11) 2-vinyl naphthalene, (12) vinylene trithiocarbonate, (13) 9-vinyl anthracene, (14) (S)-cis-verbenol, (15) (1S)-(−)verbenone, (16) tryptophol, (17) triacetin, (18) tiglic acid, (19) thymoquinone, (20) thymol, (21) thio phenoxyacetic acid, (22) 2,2,4-trimethyl-1,3-pentane dioldiisobuyrate, (23) 1,5-pentamethylenetetrazole, (24) bis-pentamethylene urea, (25) quinoxaline, (27) quinoline N-oxide hydrate, (28) quinoline carboxaldehyde, 29) quinazoline, (30) quinaldine, (31) pyrrole-2-carboxaldehyde, (32) 4-propoxy phenol, (33) triallyl-1,3,5-triazine-2,4,6-trione, (34) 2,4,6-triallyloxy-1,3,5-triazine, (35) 1,2,3,4-tetrahydroquinoline, (36) tetradecanophenone, (37) tridecyl methacrylate, (38) tricyclo[5.2.1.0]decane, (39) trimethyl cis, cis-1,3,5-cyclohexene tricarboxylate, (40) trimethyl-1,2,4-benzene-tricarboxylate, (41) sorbitan monopalmitate, (42) sorbitan monostearate, (43) tetramethyl ammoniumfluoride tetrahydrate; and mixtures thereof.

17. The method according to claim 12 wherein the filler materials of the extrudable backing substrate are selected form the group consisting of (1) zirconium oxide, (2) colloidal silicas, (3) titanium dioxide, (4) hydrated alumina, (5) barium sulfate, (6) calcium carbonate, (7) high brightness clays, (8) calcium silicate, (9) cellulosics, (10) blend of calcium fluoride and silica, (11) zinc oxide, (12) blends of zinc sulfide with barium sulfate; and mixtures thereof.

18. The method according to claim 12 wherein the thickness of the fluorescent thermoplastic extrudable backing substrate is from about 25 to about 500 microns.

19. The method according to claim 18 wherein the thickness of the metallic coating present on the backing substrate is from about 0.1 to about 25 microns.

20. The method according to claim 1 wherein, in the fluorescent thermoplastic extrudable backing substrate, the extrudable polymer or mixture thereof are present in amounts of from about 58.5 percent by weight to about 9 percent by weight, the fluorescent composition or mixture thereof are present in amounts of from about 0.5 percent by weight to about 30 percent by weight, the antistatic agent or mixture thereof are present in amounts of from about 0.5 percent by weight to about 10 percent by weight, the lightfastness inducing compounds or mixture thereof are present in amounts of from about 10 percent by weight to about 0.5 percent by weight, the plasticizer or mixture thereof are present in the in amounts of from about 30 percent by weight to about 0.5 percent by weight, the fillers or mixture thereof are present in amounts of from about 0.5 percent by weight to about 50 percent by weight.

* * * * *